US006112786A

United States Patent [19]

Otsuka et al.

[11] Patent Number: 6,112,786

[45] Date of Patent: Sep. 5, 2000

[54] METHOD AND APPARATUS FOR SCARFING A PLATE-LIKE MATERIAL

[75] Inventors: Toshiyuki Otsuka; Kiichi Yamamoto, both of Obu, Japan

[73] Assignee: Meinan Machinery Works, Inc., Obu, Japan

[21] Appl. No.: 09/332,021

[22] Filed: Jun. 14, 1999

[30] Foreign Application Priority Data

Jun. 16, 1998 [JP] Japan ..... 10-186866

[51] Int. Cl.[7] ..... B27M 1/00; B27L 3/00

[52] U.S. Cl. ..... 144/363; 144/2.1; 144/136.1; 144/329; 144/90.1; 144/91; 409/201; 409/205; 269/55

[58] Field of Search ..... 144/2.1, 134.1, 144/329, 346, 363, 371, 90.1, 91, 91.2; 83/581; 409/163, 183, 189, 197, 201, 204, 205; 269/25, 59, 56

[56] References Cited

U.S. PATENT DOCUMENTS 5,372,168 12/1994 Minami ..... 144/2.1

*Primary Examiner*—W. Donald Bray

*Attorney, Agent, or Firm*—Armstrong, Westerman, Hattori, McLeland & Naughton

[57] ABSTRACT

When scarfing the end portion of a plate-like material with irregular deformations or undulations, such as distortions, undulations and warps, the undulations are successively corrected flat and the flattened end portion is scarfed by a rotary cutter to form a highly precise scarfed surface. When the end portion of the plate-like material 3 is scarfed by the rotary cutter 5, the pressing member 11 presses, while the cutting operation proceeds, at least a part of the surface of at least that portion of the plate-like material 3 which is to be cut away as a chip 17 at a position near the blades 5*b* of the rotary cutter 5 on a downstream side of the rotary cutter with respect to a rotary cutter movement direction, the surface of the plate-like material 3 pressed by the pressing member 11 being opposite the other surface held in contact with the cutter receiving table 7.

12 Claims, 13 Drawing Sheets

METHOD AND APPARATUS FOR SCARFING A PLATE-LIKE MATERIAL

BACKGROUND OF THE INVENTION

The present invention relates to a scarfing method and apparatus for cutting end portions of plate-like materials to form scarfed surfaces. More specifically, the present invention relates to a scarfing method and apparatus which, by using cutting tools such as circular saw, milling cutter and disc cutter, scarfs end portions of plate-like materials such as veneers, plywood, MDF and particle boards and particularly end portions of thin plate-like materials that are relatively likely to develop irregular deformations or undulations.

The irregular deformations or undulations refer generally to distortions, undulations and warps.

The applicant of the present invention has proposed, in Japanese Utility Model Laid-Open No. 7-26101, a veneer scarfing apparatus which scarfs a front or rear end portion of a veneer in a direction perpendicular to the direction of veneer fibers, which extend in a direction of veneer feed. This veneer scarfing apparatus performs the scarfing as follows. That is, rather than holding the front or rear end portion of the veneer with a pressing plate during the scarfing using a cutter, as has been done conventionally, the veneer scarfing apparatus provides a suction hole in a cutter receiving table instead of using the pressing plate, attracts the veneer to the suction hole by suction, corrects undulations of the veneer and then scarfs the veneer end portion by holding the cutting position immovable, thereby producing a cut or scarfed surface in good condition which has linear cutting lines.

The applicant of this invention has also proposed, in Japanese Patent Publication No. 7-45287, a veneer cutting apparatus that uses a pressing member which, when cutting a veneer with warps and undulations in a direction perpendicular to the direction of veneer feed by a rotating cutter disc, presses a veneer surface on at least a downstream or upstream side of the cutter disc with respect to the direction of veneer feed and at the same time moves together with the cutter disc, thereby cutting the veneer linearly with high precision.

With the technology proposed by the Japanese Utility Model Laid-Open No. 7-26101, because the veneer is held to the cutter receiving table by the suction hole formed in the cutter receiving table during scarfing, if there are cracks or gaps in a portion of the veneer to be cut, the holding action by suction is not performed effectively, leaving undulations of the veneer poorly corrected and thus failing to produce a scarfed surface in good condition whose front end is strictly linear.

Further, because it is structurally impossible to form the suction hole at a position very close to a point of contact with a cutting tool, a sufficient suction cannot be applied to the plate-like material up to its front end portion. Therefore, if there are undulations in a portion to be cut, the front end portion of the plate-like material cannot securely be held by suction even when there are no gaps in that portion. This may degrade the scarfed state of the front end portion of the veneer.

Another drawback of the conventional apparatus is that if the width of the suction hole and the width of the veneer are not equal, the side portions of the veneer cannot be held by suction. That is, if the width of the suction hole is larger than the width of the veneer and when the side portions of the veneer are attracted by suction, air is inevitably taken in, weakening the suction force and resulting in an insufficient holding of the veneer side portions.

Conversely, when the width of the suction hole is narrower than the width of the veneer, a problem arises that the side portions of the veneer naturally cannot be held by suction. Therefore, each time the width of the veneer changes, the width of the suction hole needs to be changed.

With the technology proposed by the Japanese Patent Publication No. 7-45287, a pressing member is employed which presses the surface of a veneer and at the same time moves together with a cutter disc. Although the pressed area of the veneer surface is near the cut surface, because the surface of that portion of the veneer which is to be cut away as a chip by the cutter disc is not pressed, it is not possible, when the veneer has undulations, to securely hold the veneer to the cutter receiving table during scarfing, thus failing to produce a cut surface in good condition.

In connection with the above-described problems, there are the following problems. Even when the preceding methods are used to flatten undulations of the veneer by suction or pressing and scarf the flat ends of the veneer, if the scarfed veneer is not sufficiently held immovable, a cutting tool may again contact and damage the scarfed surface. This phenomenon occurs when the cut surface that has been processed by so-called "front blades" is contacted by "rear blades."

Under these circumstances, it is an object of the present invention to provide a method and apparatus for scarfing an end portion of a plate-like material, which can produce a highly precise cut surface even when the plate-like material has undulations.

Another object of the present invention is to provide a method and apparatus which can prevent a scarfed surface from being damaged by the same cutting tool that has formed the scarfed surface, thereby maintaining a good scarfed surface.

Therefore, a method and apparatus for scarfing a plate-like material is characterized in that end portions of the plate-like material are cut to form scarfed surfaces by a rotary cutter, which linearly moves relative to the plate-like material, and by a cutter receiving table, with which blades of the rotary cutter are kept in contact and which receives and supports a pressing force from a pressing member; and that, on a downstream side of the rotary cutter with respect to the direction of a cutter linear movement relative to the plate-like material, the pressing member presses during the cutting operation at least a part of the surface of at least that portion of the plate-like material which is to be cut away as a chip from the plate-like material at a position near the blades of the rotary cutter, the surface of the plate-like material pressed by the pressing member being opposite the other surface held in contact with the cutter receiving table.

The method and apparatus for scarfing a plate-like material is also characterized in that, on an upstream side of the rotary cutter with respect to the direction of a cutter linear movement relative to the plate-like material, a cut surface engagement member is pressed against or set close to a scarfed surface near the blades of the rotary cutter while a cutting operation proceeds.

DETAILED DESCRIPTION OF THE INVENTION

Embodiments of the present invention will be described by referring to the accompanying drawings. For easy understanding of the invention, the drawings are simplified or schematically illustrated (with dimensions modified).

First, a method and apparatus for cutting a plate-like material with a rotary cutter to form a scarfed surface according to one embodiment of the invention will be explained.

Among major plate-like materials to be processed by this invention are wood-based plate materials, such as veneers, plywood, MDF and particle boards. Other plate-like materials include those made of insulating materials, plaster and asbestos boards.

Figure 1:
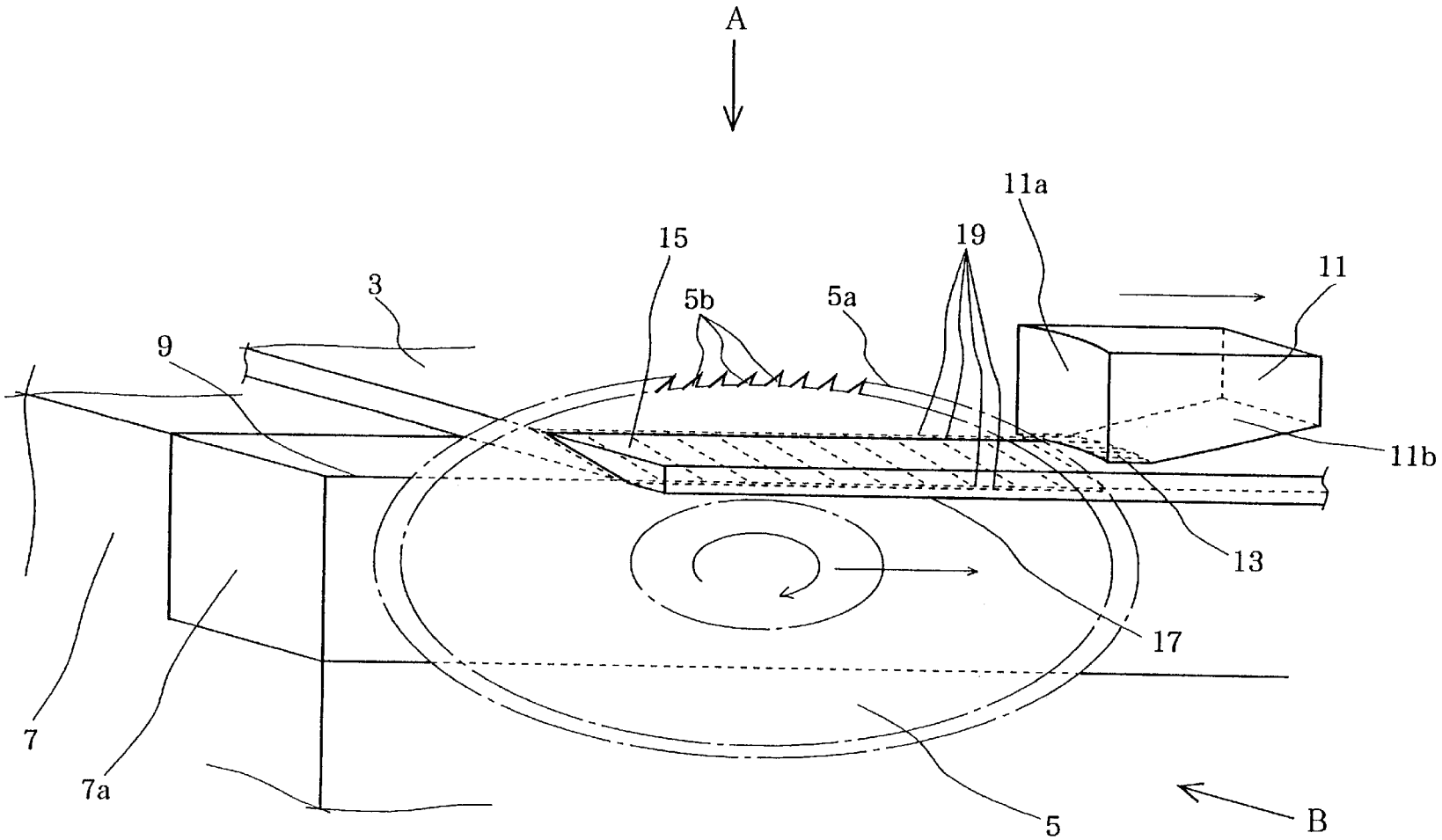
FIG. 1 is a perspective view showing how the veneer is cut by a circular saw to form a scarfed surface.
Figure 2:
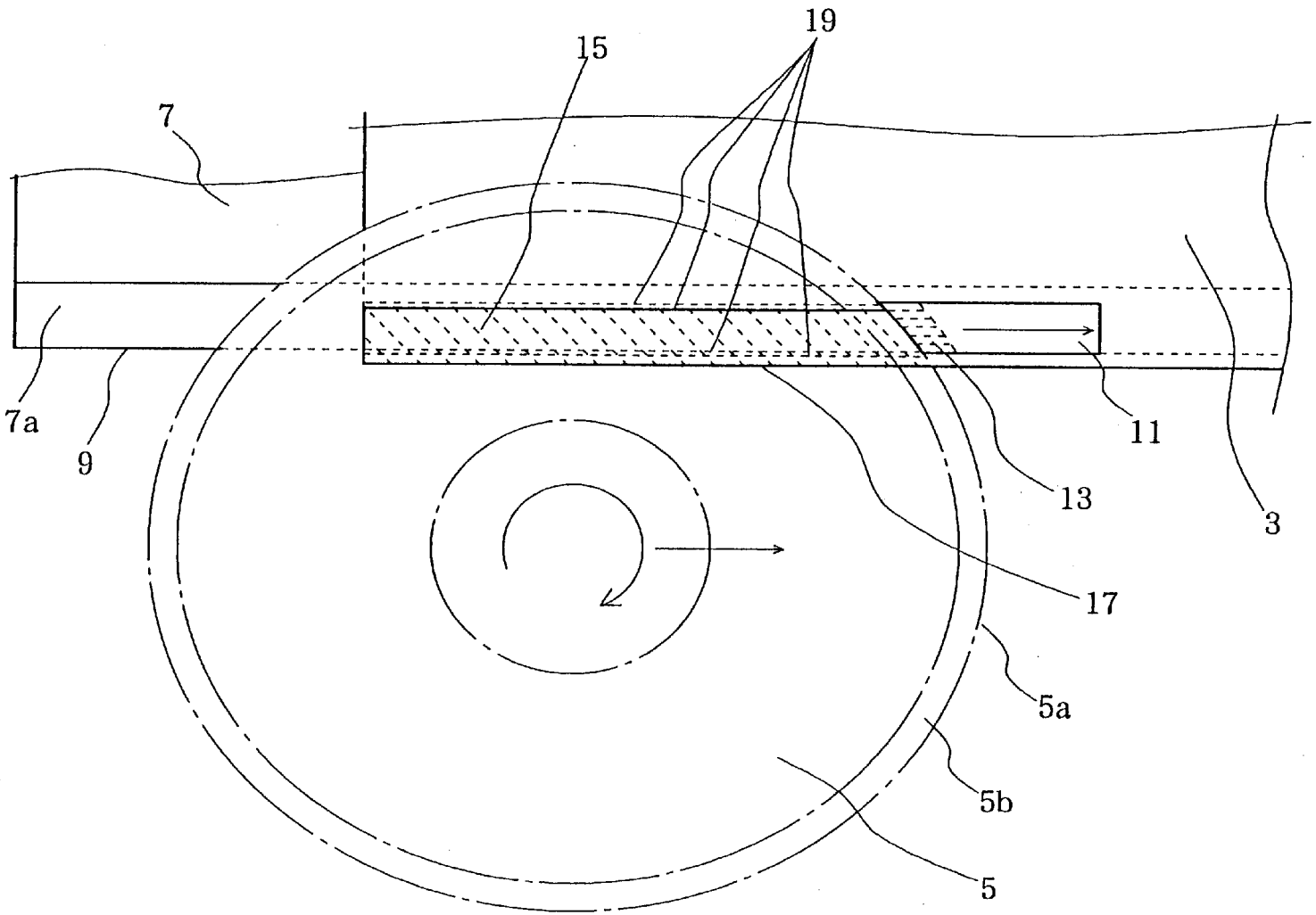
FIG. 2 is a plan view of FIG. 1.
Figure 3:
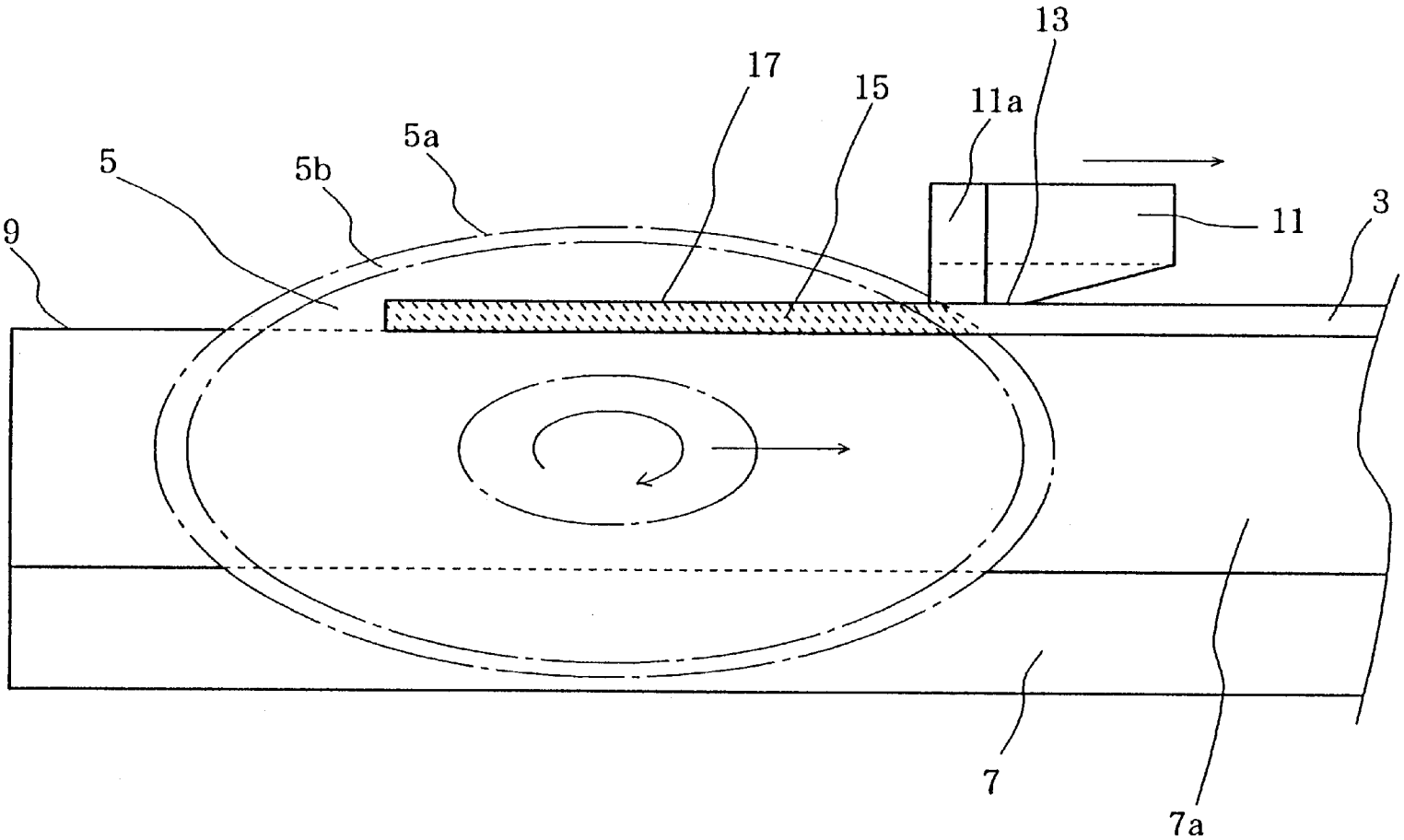
FIG. 3 is a front view of FIG. 1.

This embodiment describes a process of cutting ends of veneers prior to making so-called scarf joints in which the veneer ends are joined successively in the direction of veneer fiber FIG. 1 is a perspective view showing the end of a veneer 3 being cut by a rotary cutter 5 into a scarfed surface. FIG. 2 is a plan view of FIG. 1 as seen from an arrow A, and FIG. 3 is a front view of FIG. 1 as seen from an arrow B.

The veneer 3 is controlled to be fed in the direction of veneer fiber and stopped at a predetermined cutting position. With the veneer 3 held immovable, the rotary cutter 5 is rotated in the direction of arrow in the figure while at the same time the cutter is linearly moved in the direction of arrow, i.e., in a direction perpendicular to the veneer fiber direction.

Although FIG. 1 omits a fiber pattern in the veneer 3 for the sake of simplicity, the direction of veneer fiber is perpendicular to the direction in which the rotary cutter 5 is linearly moved.

The rotary cutter used in this embodiment is a circular saw 5 having a number of blades 5*b* around its circumference. The rotary cutter 5 is hereinafter referred to as a circular saw 5. Denoted 5*a* is a locus described by tips of the blades 5*b* as the circular saw 5 rotates. The circular saw 5 is tilted with respect to the direction of the veneer fiber and the tilt angle of the circular saw 5 constitutes a tilt angle of a scarfed surface.

As the cutting by the circular saw 5 proceeds, a scarfed surface 15 shown shaded with inclined broken lines in the figure is formed and a chip 17 is produced. Solid and broken lines 19 represent cutting lines long which the veneer was cut by the circular saw 5.

Next, a cutter receiving table 7 will be described. The cutter receiving table 7 serves as a table on which to place the veneer 3 and also as a base for supporting a pressing force from a pressing member 11 described later. At one end of the cutter receiving table 7 is provided a blade tip contact portion 9 which contacts the blades 5*b* of the circular saw 5. The blade tip contact portion 9 is a member with which the blades 5*b* are placed in contact to cut the end portion of the veneer 3 to form a scarfed surface.

The cutter receiving table 7 has at its end portion a replaceable blade receiving portion 7*a* whose edge constitutes the blade tip contact portion 9. To enhance a precision of engagement between the circular saw 5 and the blade receiving portion 7*a,* the blade tip contact portion 9 is formed in advance by linearly sliding the circular saw 5, while being rotated, against the edge of the blade receiving portion 7*a*. For this purpose, a synthetic resin with good machinability is used for the blade receiving portion 7*a*.

Next, the pressing member 11 is explained. The pressing member 11 presses a surface of the veneer 3 opposite the other surface in contact with the cutter receiving table 7 on a downstream side of the circular saw 5 with respect to the direction of circular saw linear movement. Further, the pressing member 11 can press the surface of all or at least a part of that portion of the veneer 3 which is to be cut away as a chip from the veneer 3 at a position very close to the blade tip locus 5*a* of the circular saw 5.

The "downstream side of the circular saw 5 with respect to the direction of its linear movement" means a downstream side of a reference plane extending along a rotating shaft of the circular saw 5 and perpendicular to the direction of movement of the circular saw 5. Therefore, an upstream side means an upstream side of the reference plane.

The surface of the veneer 3 pressed by the pressing member 11 is shown as a pressed surface 13 in FIGS. 1, 2 and 3. As can be seen from FIGS. 1 and 2, the pressed surface 13 is near the boundary between the cut chip 17 and the veneer 3, i.e., a portion which becomes a chip 17 as the cutting by the circular saw 5 proceeds.

The pressing member 11 does not necessarily have to press all of the portion to be cut away as a chip from the veneer 3 but need only to press a part of that portion.

Further, the pressing member 11 may also press the surface of other than the portion to be cut away as a chip from the veneer 3, but is required to press at least the portion to be cut away as a chip.

In this way, when the circular saw 5 cuts the veneer 3, it cuts a portion that has been pressed by the pressing member 11 prior to cutting.

The pressing member 11, like the circular saw 5, moves linearly in the direction of arrow in the figure perpendicular to the direction of veneer fiber while pressing the veneer 3; that is, in a direction perpendicular to the veneer feed.

To set the pressing member 11 as close to the blade tip locus 5*a* as possible Requires that a surface of the pressing member 11 closest to the blade tip locus 5*a* be formed into a curved surface 11*a* that corresponds in shape to the blade tip locus 5*a*. A bottom surface 11*b* of the pressing member 11 is inclined in the direction of movement as shown so that the pressing member 11 can be moved easily while pressing against irregular deformations or undulations of the surface of the veneer 3.

A material suited for the pressing member 11 is, for example, a synthetic resin with a small frictional coefficient.

When the end portion of the veneer 3 to be cut has irregular deformations or undulations, the pressing member 11 with the above-described construction presses against and corrects the undulations to form a flat surface prior to the cutting by the circular saw 5. Because the circular saw 5 cuts a portion of the veneer which is corrected flat, it is possible to produce a scarfed surface with a high precision not possible with the conventional apparatus.

Figure 4A:
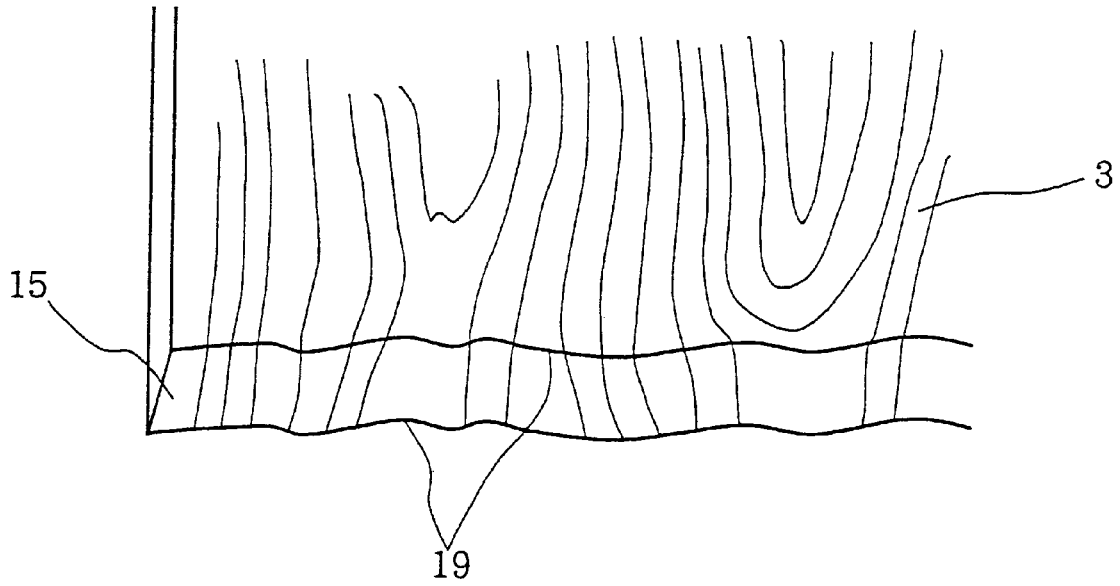
FIGS. 4A and 4B are perspective views showing scarfed surfaces formed by the circular saw.
Figure 4B:
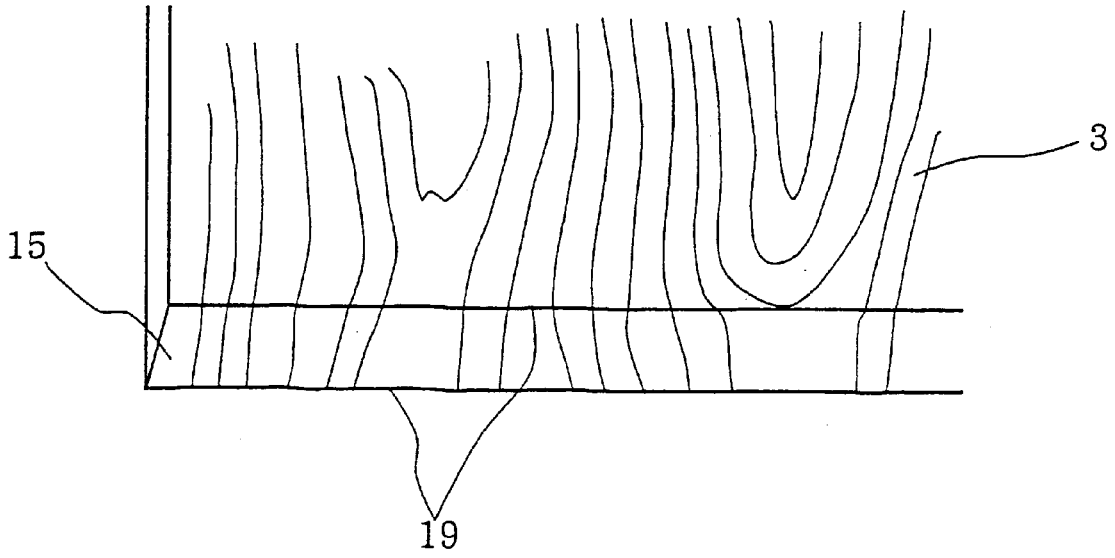

FIGS. 4*a* and 4*b* show scarfed surfaces 15 cut by the circular saw 5, with FIG. 4*a* representing the scarf formed by not using the pressing member 11 and FIG. 4*b* the scarf formed by using it.

In the case of FIG. 4*a*, nonlinear cut lines 19 are formed according to the state of undulations of the veneer 3. The scarfed surface with such a low machining precision not only cannot form a good scarf joint in subsequent processes but also may cause a failed joint. In the case of FIG. 4*b*, the cut lines 19 are linear, forming a highly precise scarfed surface.

Next, by referring to FIG. 5 a method and apparatus will be explained which cuts the veneer 3 to form a scarfed surface by pressing the cut scarfed surface with a cut surface engagement member 21 described later (hereinafter referred to as a scarfed surface engagement member 21), or positioning it near the cut scarfed surface, to hold the scarfed surface immovable while scarfing the end of the veneer 3.

Figure 5A:
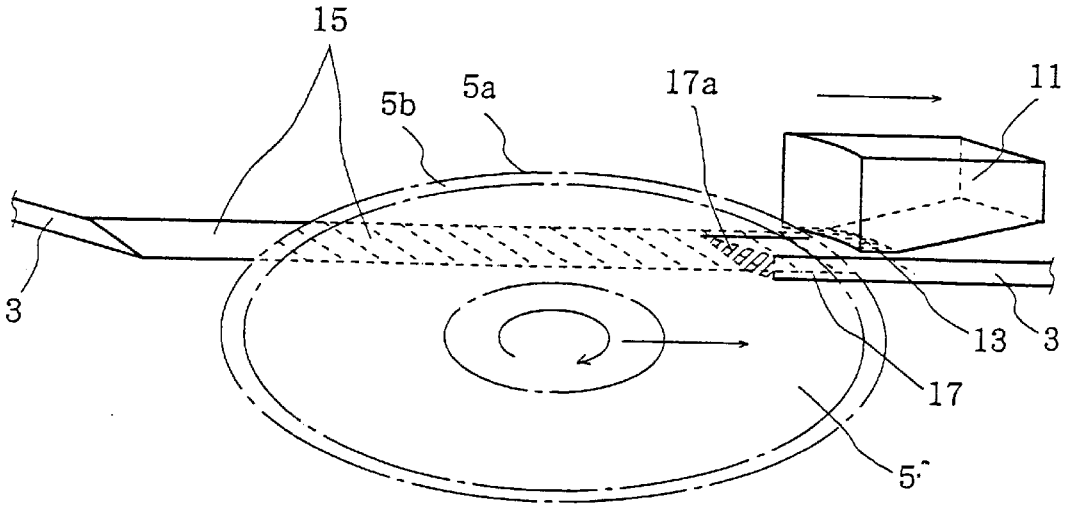
FIGS. 5A and 5B are perspective views showing the action of a member engaging the scarfed surface.
Figure 5B:
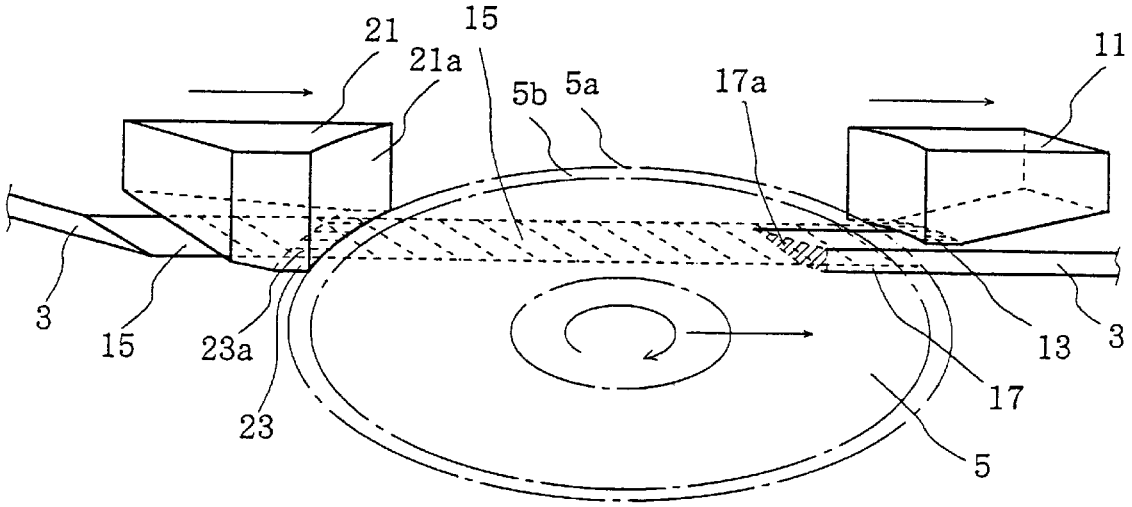

FIGS. 5*a* and 5*b* are perspective views illustrating the action of the scarfed surface engagement member 21. FIG. 5*a* shows how the scarfed surface formed by the circular saw 5 is damaged by the blades 5*b* of the circular saw 5 which contact the scarfed surface again as the veneer scarfing proceeds.

The damage to the scarfed surface is generally understood to be caused by "rear blades" of a cutter coming into contact with the surface already scarfed by "front blades" of the cutter. That is, if the veneer 3 is kept completely flat, there is theoretically no possibility of the scarfed surface being contacted by the rear blades. Because the veneer 3 in practice is very rarely flat, the scarfed surface becomes damaged by the rear blades.

The above problem can be avoided by the following conventional method. To prevent the rear blades of the rotating circular saw 5 from contacting the scarfed surface, the conventional practice performs a so-called healing, which involves slightly tilting the main axis of the circular saw 5 to lower the front blades of the circular saw 5 and raise the rear blades with respect to the scarfed surface. With this method, even when the veneer 3 has undulations of certain magnitudes, if the rear blades are raised above the undulations, the scarfed surface is clear of the rear blades and remains intact. When the undulations of the veneer 3 are large, however, the scarfed surface are contacted by the rear blades.

Although it is possible to avoid contact with the rear blades by further increasing the healing, this raises another problem. That is, because the front blades are excessively lowered, the scarfed surface has a curved plane that corresponds to the blade tip locus of the circular saw 5. When the scarfed surface is not flat but curved, the scarfed surfaces cannot be joined completely in the subsequent scarf joining process, producing a partly joined or faulty scarf joint.

To solve the above problem, a scarfed surface engagement member 21 as shown in FIG. 5*b* is provided. The scarfed surface engagement member 21, like the circular saw 5 and the pressing member 11, can be moved linearly in the direction of arrow in the figure perpendicular to the direction of veneer fiber. The scarfed surface engagement member 21 can press or be set close to at least a part of the scarfed surface formed by the circular saw 5 at a position very close to the blade tip locus 5*a* on the upstream side of the circular saw 5 with respect to the direction of circular saw movement.

A bottom surface 23 of the scarfed surface engagement member 21 is formed almost parallel to a plane including a locus described by the blades 5*b* as the circular saw 5 is rotated, or the blade tip locus 5*a*. Therefore, if the scarfed surface 15 is pressed by the scarfed surface engagement member 21, the scarfed surface is prevented from being contacted again by the blades 5*b* of the circular saw 5 even when the veneer 3 has, for instance, undulations because the undulations are corrected flat by the pressing force of the scarfed surface engagement member 21.

Rather than pressing the scarfed surface engagement member 21 against the scarfed surface, the scarfed surface engagement member 21 may be set as close to the scarfed surface as possible to produce the similar effect. The portion of the scarfed surface which is pressed or approached by the scarfed surface engagement member 21 is shown in the figure as an engaged scarfed surface portion 23*a*.

A cross section 17*a* shown shaded with inclined lines in FIG. 5*b* represents a broken surface when the cut chip 17 is broken off by a break saw 50 described later. Crushing the chip 17 by the break saw can prevent the chip 17 from striking a curved surface portion 21*a* of the scarfed surface engagement member 21. Crushing the chip 17 also makes it easy to collect the chip 17 as by a dust collector.

(Embodiments)

Figure 6:
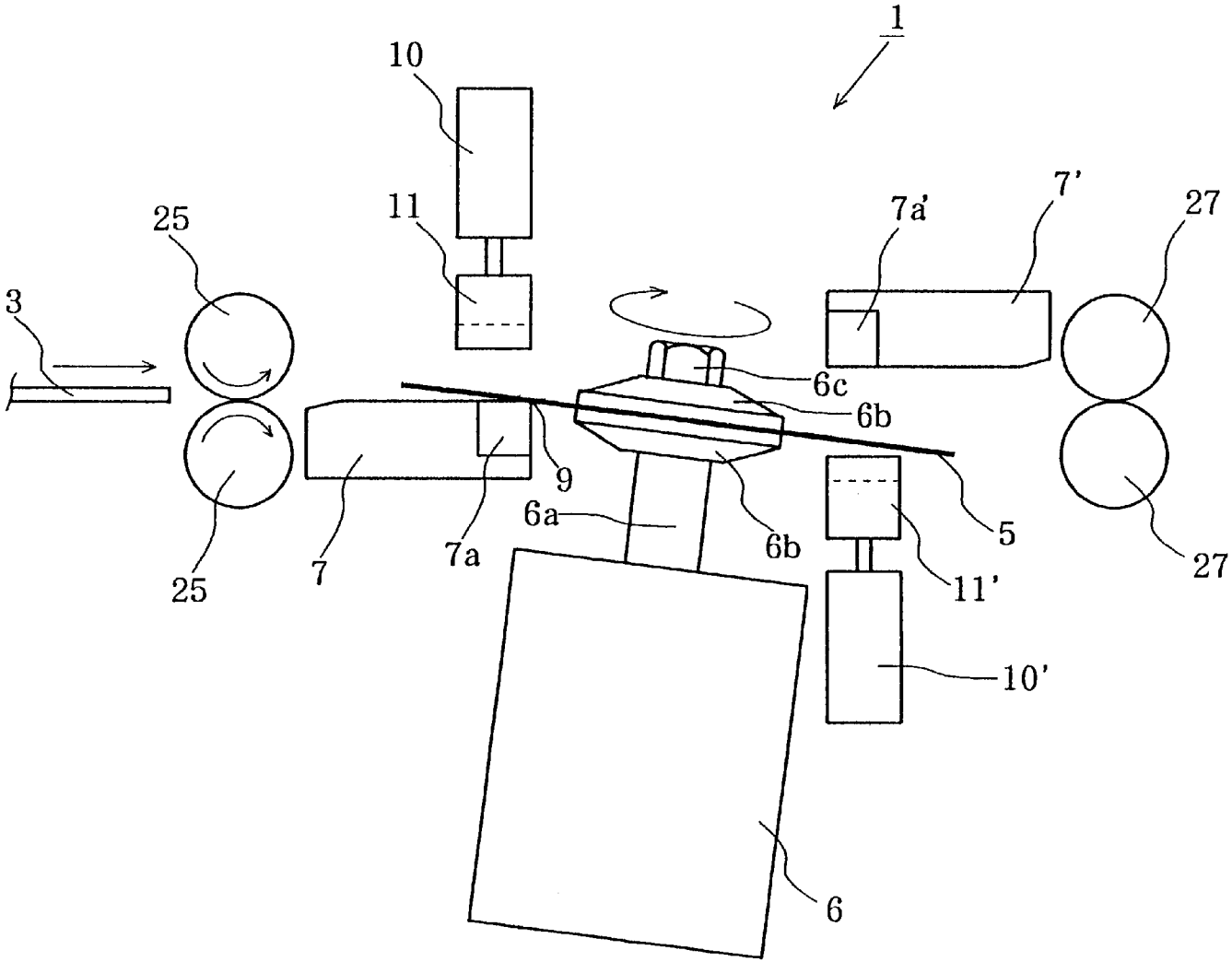
FIG. 6 is a schematic side view showing the operation of a scarfed surface forming apparatus.
Figure 7:
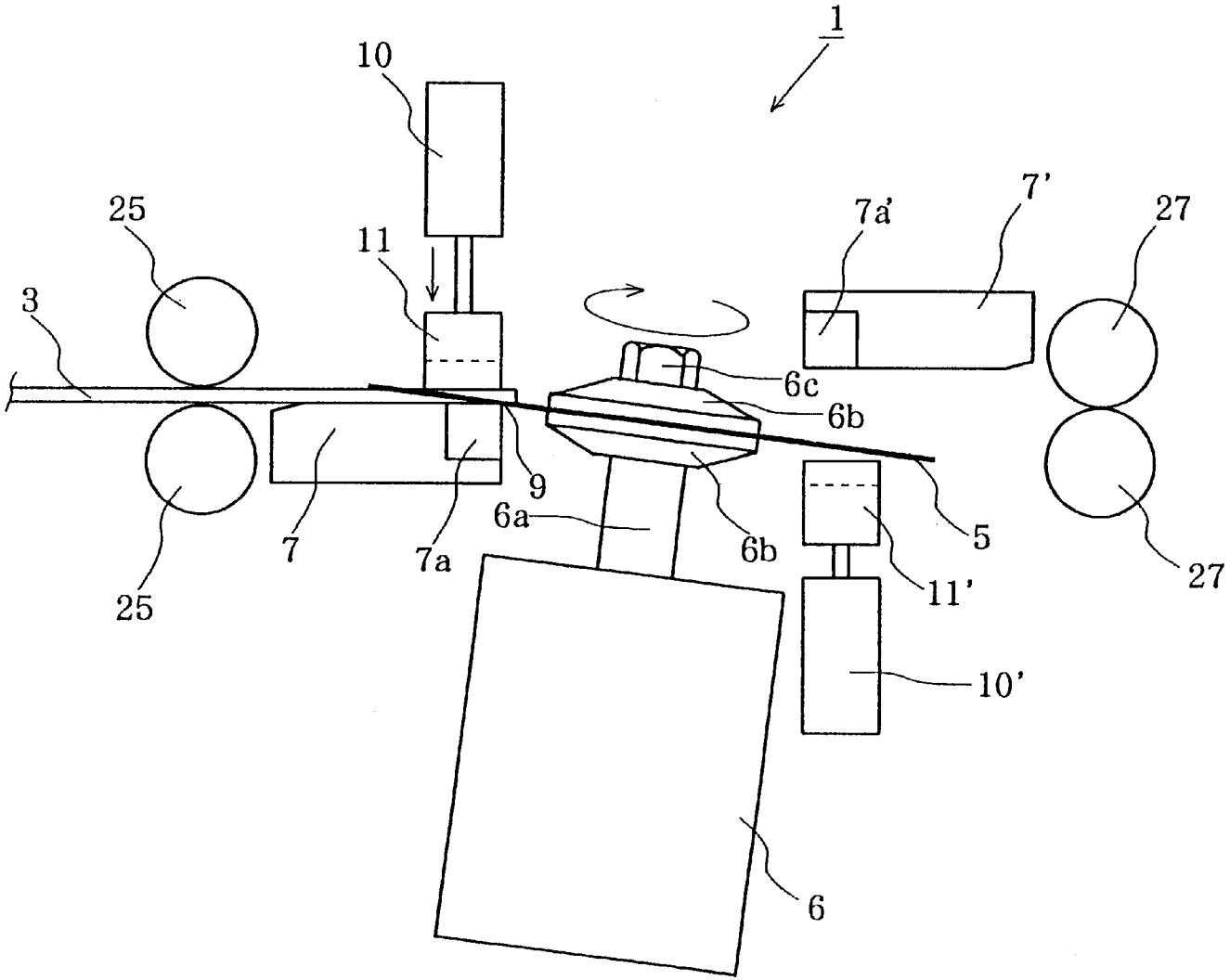
FIG. 7 is a schematic side view showing the operation of the scarfed surface forming apparatus.
Figure 8:
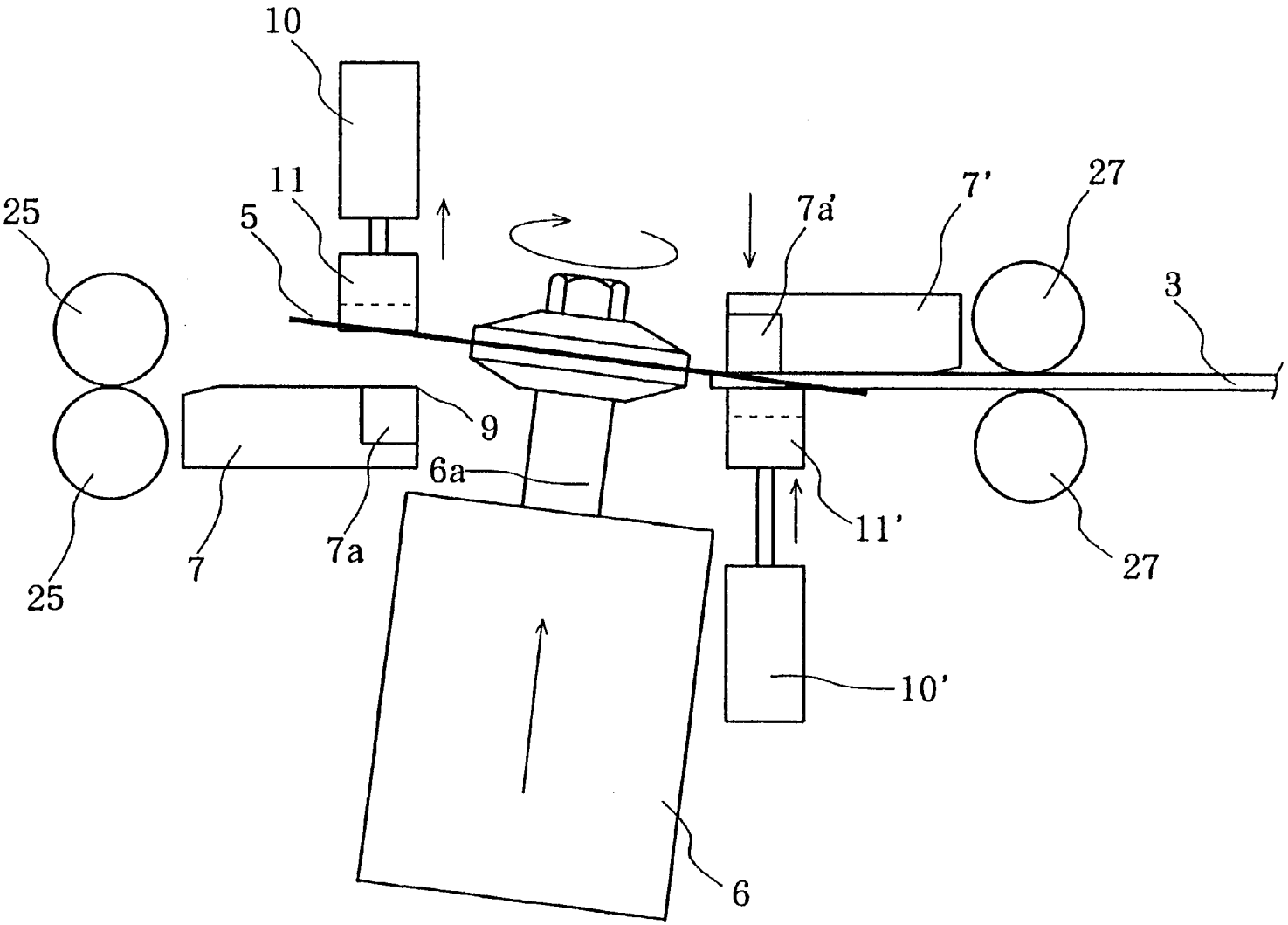
FIG. 8 is a schematic side view showing the operation of the scarfed surface forming apparatus.

Embodiments of the present invention will be described in detail by referring to FIGS. 6 to 10. FIGS. 6 to 8 are schematic side views showing the operation of a scarfed surface processing apparatus 1. FIGS. 9 and 10 are schematic front views showing the operation of the pressing member 11.

The scarfed surface processing apparatus 1 is installed on the inlet side of the veneer joining apparatus (not shown) used in a subsequent process and cuts the front and rear ends, with respect to the direction of feed, of the veneer 3 carried by feed rolls 25 to form scarfed surfaces at a predetermined angle by the circular saw 5. In this embodiment, an object material to be processed is a dry veneer up to 6–7 mm thick. As for irregular deformations or undulations of veneer, dry veneers have more conspicuous undulations than raw veneers and undulations tend to be larger at end portions in the direction of veneer fiber than at other portions.

The feed rolls 25 are a pair of upper and lower rolls having rotating axes perpendicular to the direction of feed of the veneer 3 and are driven by an electric motor to transport the veneer 3 in the direction of arrow in the figure, i.e., in the direction of veneer fiber. The feed rolls 25 not only take in the veneer 3 but also damp it immovable when the veneer 3 is cut by the circular saw 5.

On the downstream side of the feed rolls 25 with respect to the direction of veneer feed is installed a cutter receiving table 7, which serves not only as a table on which to place the veneer 3 but also as a support when cutting the veneer 3 with the circular saw 5. The upper surface of the cutter receiving table 7 is set almost flush with a feeding plane of the feed rolls 25.

At the downstream end of the cutter receiving table 7 with respect to the veneer feed direction is installed a replaceable blade receiving portion 7*a*. One edge of the blade receiving portion 7*a* forms a blade tip contact portion 9 with which the blades 5*b* of the circular saw 5 are kept in contact when cutting the veneer 3. Keeping these two members in contact with each other assures a high-precision scarfed surface, which is linear at the front end.

To enhance the contact precision between the circular saw 5 and the blade receiving portion 7*a*, the edge of the blade receiving portion 7*a* is cut by sliding the rotating circular saw 5 against the edge to form the blade tip contact portion 9 in advance. For this purpose, the blade receiving portion 7*a* uses as its material a synthetic resin or wood with good machinability.

Next, veneer detectors of known technology, though not shown, are arranged above the cutter receiving table 7 in a direction perpendicular to the veneer feed direction at predetermined intervals corresponding to a detection precision of the veneer 3. The veneer detectors have a detection roll and a detection member such as limit switch for detecting the movement of the detection roll, and can produce a detection signal and a non-detection signal representing the presence or absence of the end of the veneer 3. Hence, when the veneer 3 is carried in, the detection roll detects the front end of the veneer 3 and then the detection member that has detected the movement of the detection roll generates a front end detection signal. Based on this detection signal, a known control means controls the feed rolls 25 to stop the front end of the veneer 3 at a predetermined position.

While the veneer 3 is being taken in and out, the circular saw 5 is located at a standby position retracted from a transport path of the veneer 3 as shown in FIG. 9 and therefore does not interfere with the advance of the veneer 3.

Next, the circular saw 5 will be explained. As can be seen from FIG. 6, the circular saw 5 is secured to a flange 6*b* of a rotating shaft 6*a* of a drive motor 6 by a fixing member 6*c*. The rotating shaft 6*a* is tilted about 7 degrees with respect to the direction of feed of the veneer 3. Hence, the tilt angle of the scarfed surface cut by the circular saw 5 secured to the rotating shaft is also 7 degrees. The ratio between the thickness of the veneer 3 and the length of inclined scarfed surface is about 1:8. The tilt angle of the circular saw 5 does not have to be limited to 7 degrees and may be changed to a desired value according to the required joining strength. In this drawing, the circular saw is shown tilted at a large angle to facilitate understanding.

Next, a means for linearly moving the circular saw 5 in a direction perpendicular to the veneer fiber direction, though not shown, uses the following known means.

First, the drive motor 6 is secured to a moving table. The moving table is held on a track through linear motion bearings. A drive pulley driven by an electric motor drives a drive belt securely connected to the moving table, so that the moving table can be moved back and forth on the track.

When the veneer 3 is stopped at a predetermined position, the circular saw 5 rotated by the drive motor 6 starts to be linearly moved in a direction perpendicular to the veneer fiber direction.

Figure 9A:
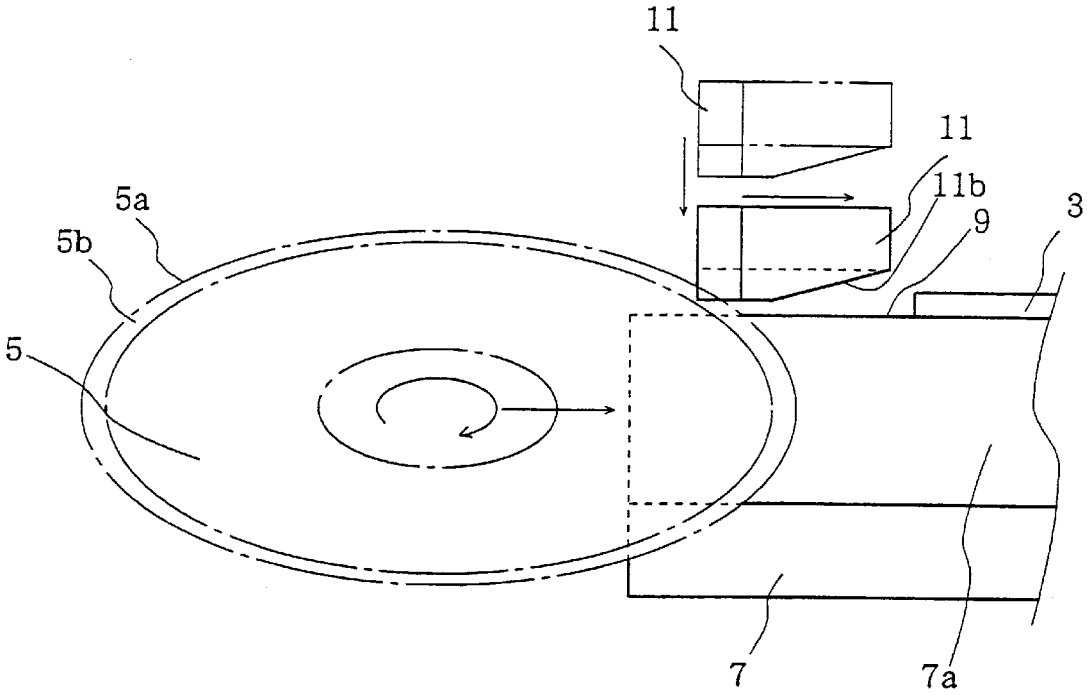
FIGS. 9A and 9B illustrate schematic front and plan views, showing the operation of a pressing member.
Figure 9B:
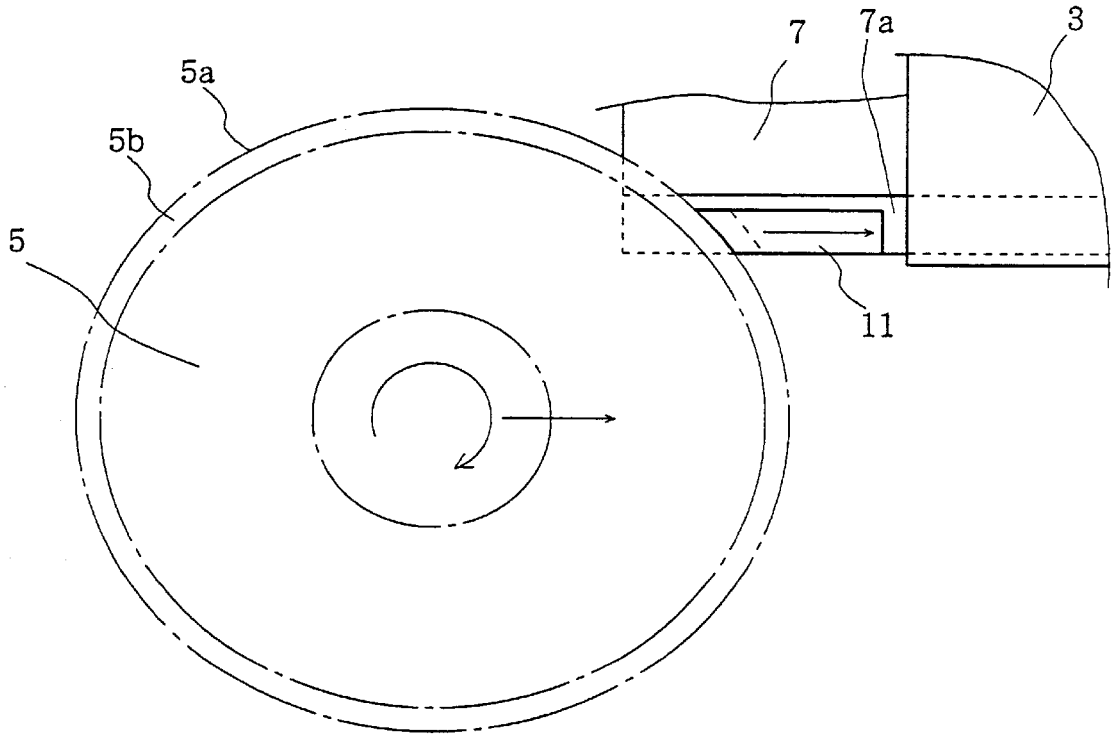
Figure 10A:
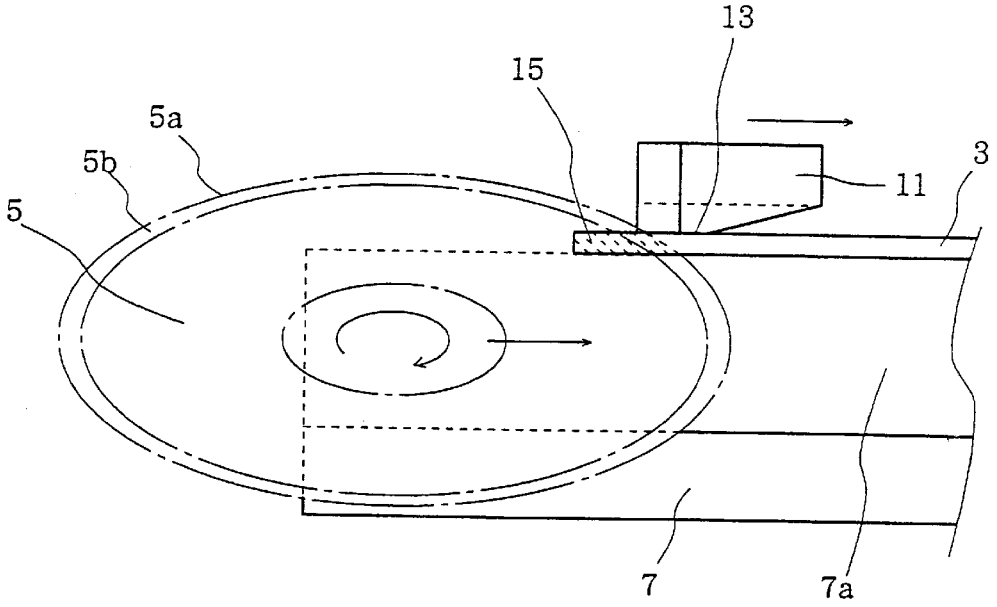
FIGS. 10A and 10B illustrate schematic front and plan views, showing the operation of the pressing member.

At this time, as shown in FIG. 7 and FIG. 9*a*, the pressing member 11, which was standing by above the cutter receiving table 7, is pushed down from the standby position by a press cylinder 10 or a pressurization means prior to the cutting of the veneer 3 by the circular saw 5. This is to press the pressing member 11 against undulations of the veneer 3 so that the undulations are corrected flat before the veneer end is cut with the circular saw 5.

Next, which part of the veneer 3 is pressed by the pressing member 11 will be described. First, let us briefly explain about the conventional method of correcting undulations of a veneer. The conventional undulation correction method involves simultaneously pressing an area of the veneer near its end over the entire width as seen from the direction of feed to correct the undulations. The undulated portion has a longer length than the non-undulated portion by an undulated amount, so that if the undulated veneer is pressed over the entire width simultaneously as described above, the undulations are forcibly straightened out at one time, causing the undulated portions to crack or break or even other non-undulated portions to crack, and thus degrading the quality of the veneer.

When the undulations are simultaneously pressed and flattened, a significantly large pressing force is required. Hence, depending on the magnitudes of undulations, there are cases where the undulations cannot be corrected and the scarfing is performed with the veneer surface left undulated. Further, a sufficient mechanical strength to withstand the pressing force is required of the apparatus itself.

As described in the "BACKGROUND OF THE INVENTION," conventional correction methods, such as one that holds the front end portion of a veneer by suction or one that uses a moving pressing member which presses an area of the veneer near a cutting plane, do not securely press the front end portion of the veneer. Because of this construction, the conventional methods cannot hold the veneer firmly against the cutter receiving table when scarfing the veneer and thus may not be able to produce a scarfed surface in good condition.

The pressing member 11 of this invention is intended to solve these drawbacks and enhance the precision of scarfing.

Figure 10B:
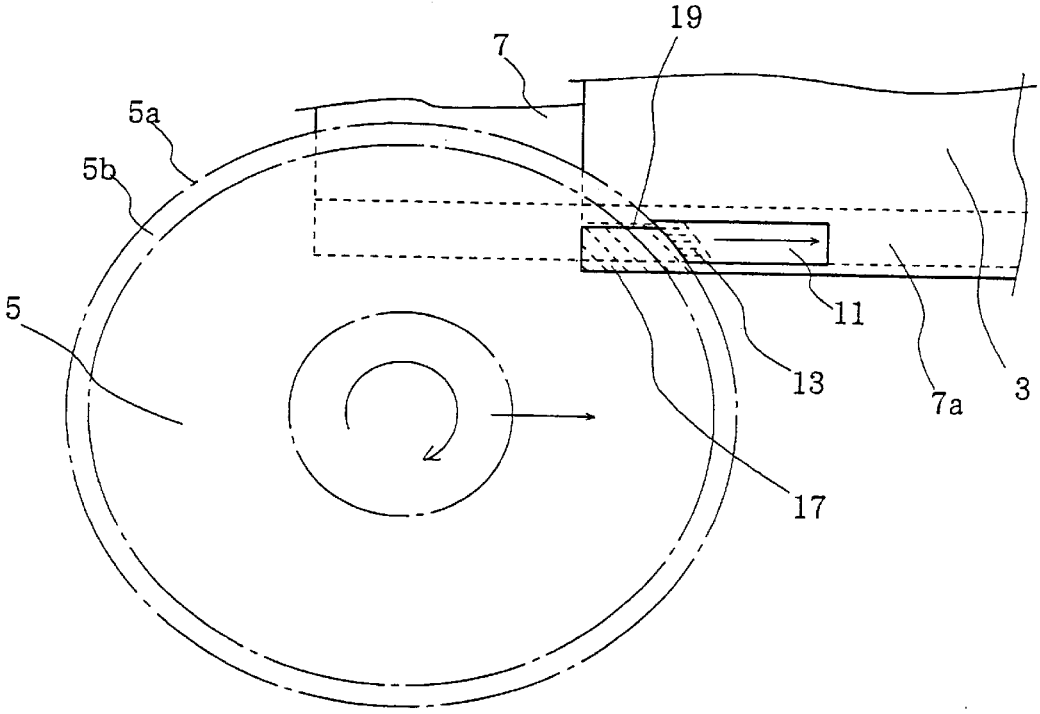

As can be seen from FIG. 10*b*, the pressed surface 13 pressed by the pressing member 11 is a part of the veneer surface which is very close to the blade tip locus 5*a* on the downstream side of the circular saw 5 with respect to the direction of the circular saw movement and which is to be cut away as a chip from the veneer 3 by the circular saw 5 (hereinafter referred to as a chip portion). It is noted, however, that the pressing member 11 does not need to press the entire width, as seen from the direction of feed, of the chip portion very close to the blade tip locus 5*a* and may press at least a part of the chip portion.

Further, the pressed surface 13 may cover not only the chip portion but also an area upstream of the cut line 19 with respect to the direction of feed. This is because the scarfing precision can be enhanced if the pressing member 11 presses at least the chip portion of the veneer 3. When, for example, the thickness of the veneer 3 is changed, the cut line 19 shifts upstream or downstream with respect to the direction of veneer feed by a distance corresponding to a change in veneer thickness. When the veneer thickness is reduced for example, the cut line 19 shifts downstream. In this case, if the pressing member 11 is not modified, the pressed surface 13 extends to an upstream side of the cut line 19.

Next, the operation of the pressing member 11 will be explained. Because the pressing member 11 is driven by a cylinder 10 mounted on the moving table, not shown, of the circular saw 5, it can be moved bodily along with the circular saw 5.

When the lowered pressing member 11 starts moving in a direction perpendicular to the veneer fiber direction, the pressing member 11 rides smoothly over the veneer 3 because the bottom surface 11*b* of the pressing member 11 is inclined as shown in FIG. 9A. The pressing member 11 slides over the surface of the veneer 3 while pressing the veneer surface with a desired force applied by the pressing cylinder 10. Because the pressing member 11 slides over the veneer 3 in this way, a material with a small frictional coefficient, such as synthetic resin, is used for the pressing member 11 to eliminate undue forces, such as frictional forces, acting on the veneer 3.

Next, the lowermost position assumed by the pressing member 11 before it moves onto the veneer 3 will be explained.

For the purpose of pressing the veneer 3, the lowermost position of the pressing member 11 need only be equal to or lower than the height of the thickness of the veneer 3 from the surface of the cutter receiving table 7. The pressing member 11 may be further lowered until it contacts the cutter receiving table 7. Although this embodiment has the pressing member 11 stand by above the cutter receiving table 7, the pressing member 11 may be held, from the beginning, at a lowered standby position which is less than the veneer thickness above the cutter receiving table 7 or may be kept in contact with the cutter receiving table 7, because the inclined bottom surface of the pressing member 11 allows the pressing member 11 to ride over the veneer 3 without a problem.

Next, the undulation correction action of the pressing member 11 will be explained.

First, when the pressing member 11 is lowered to clamp the veneer 3 between it and the cutter receiving table 7 and is moved bodily together with the circular saw 5, the pressing member 11 straightens out the deformations or undulations of the veneer 3 successively downstream with respect to the direction of its movement. Because the undulations are not straightened out simultaneously, the undulated portions can be prevented from being cracked or broken or inducing cracks in other non-deformed portions. Further because only a part of the undulations is pressed down at one time, the apparatus does not need a special mechanical strength.

Because the pressing member 11 presses against a portion of the veneer in front of and close to where the circular saw 5 is about to cut, a high-precision scarfed surface, not possible with the conventional undulation correction methods, can be obtained.

With the scarfing of the front end portion of the veneer 3 finished, the veneer 3 is fed by the feed rolls 25 for the rear end portion to be scarfed. Provided downstream of the circular saw 5 with respect to the direction of veneer feed are a rear end cutter receiving table 7', a rear end blade receiving portion 7*a*', a rear end pressing member 11' and a rear end pressing cylinder 10'. The functions of these members are the same as those of the members used for scarfing the front end portion of the veneer 3 and their arrangements are only vertically reversed. As shown in FIGS. 6 and 7, the rear end cutter receiving table 7' is located higher than the feed plane of the veneer 3.

When the rear end portion of the veneer 3 is to be cut, the rear end cutter receiving table 7' is lowered to the feed plane of the veneer 3 by the action of a raise/lower cylinder (not shown) connected to the rear end cutter receiving table 7', as shown in FIG. 8, to prepare for the cutting of the rear end. At the same time, the circular saw 5 is raised by a raise/lower cylinder (not shown) connected to the drive motor and works together with the rear end cutter receiving table 7' to cut the rear end portion of the veneer. Provided downstream of these members are takeup rolls 27.

The veneer 3 supplied from the feed rolls 25 and handed over to the takeup rolls 27 continues to be transported. Then, when the rear end of the veneer 3 is detected by the detection roll, the detection member that has detected the movement of the detection roll generates a rear end detection signal. Based on the detection signal, a known control means controls the takeup rolls 27 to stop the rear end of the veneer 3 at a predetermined position.

When the veneer 3 stops at a predetermined position, the rear end cutter receiving table 7' is lowered and the circular saw 5 rotated by the drive motor 6 is raised and starts moving linearly in a direction perpendicular to the veneer fiber direction. At this time, as shown in FIG. 8, the rear end pressing member 11' which was standing by below the rear end cutter receiving table 7' is raised from the standby position by the rear end pressing cylinder 10' or a pressurization means to press against the veneer 3 prior to the scarfing of the rear end portion of the veneer 3 by the circular saw 5. This process is intended to press the rear end pressing member 11' against undulations of the veneer 3 to correct them flat so that the circular saw 5 can cut the flattened portion of the veneer, as in the case of the scarfing of the front end portion.

The rear end pressing member 11', like the pressing member 11, presses against that part of the veneer surface which is very close to the blade tip locus 5*a* on the downstream side of the circular saw 5 with respect to the direction of circular saw movement and which is a chip portion to be cut away as a chip from the veneer 3 by the circular saw 5. As in the case of the pressing member 11, the rear end pressing member 11' does not need to press the entire width, as seen from the direction of feed, of the chip portion very dose to the blade tip locus 5*a* and may press at least a part of the chip portion. Further, the rear end pressing member 11' may cover not only the chip portion but also an area downstream of the cut line 19 with respect to the direction of feed. This is because the scarfing precision can be enhanced if the rear end pressing member 11' presses at least the chip portion of the veneer 3.

Because the rear end pressing member 11' is driven by a cylinder 10' mounted on the moving table, not shown, of the circular saw 5, it can be moved along with the circular saw 5 as in the case of the pressing member 11.

Further, because the rear end pressing member 11' has an inclined surface, not shown, similar to the bottom surface 11*b* of the pressing member 11, it can smoothly move onto the veneer 3.

As shown in FIGS. 6 and 7, although the rear end pressing member 11' is kept standing by below the rear end cutter receiving table 7', the rear end pressing member 11' may be held, from the beginning, at a raised standby position which is less than the veneer thickness from the rear end cutter receiving table 7' or may be kept in contact with the rear end cutter receiving table 7'.

Now, by referring to FIG. 5B, the scarfed surface engagement member 21 will be explained again. As described above, the scarfed surface engagement member 21, as with the circular saw 5 and the pressing member 11, moves linearly in the direction of arrow in the figure, i.e., in a direction perpendicular to the direction of veneer fiber and can press or approach at least a part of the scarfed surface formed by the circular saw 5 at a position very close to the blade tip locus 5*a* of the circular saw 5 on the downstream side with respect to the direction of the saw movement.

FIG. 5B shows how the scarfed surface of the front end portion is held immovable. Though not shown, another scarfed surface engagement member constructed with the similar concept is provided also for the scarfed surface of the rear end portion.

Though not shown, the scarfed surface engagement member 21 is vertically driven by a pressing means such as a cylinder to press the scarfed surface. Like the pressing member 11, the scarfed surface engagement member 21 is standing by at a position away from the cutter receiving table 7 and is driven to press the scarfed surface as the circular saw 5 moves.

The scarfed surface engagement member 21, if it is shaped like the one shown in FIG. 5B, can be kept in contact with the cutter receiving table during standby. This is because when the bottom surface 23 with the same inclination angle as the scarfed surface engages the blade tip contact portion 9, the lowered position of the scarfed surface engagement member 21 is restricted. Hence, even when the scarfed surface engagement member 21 is held in contact with the cutter receiving table 7 in advance, it can ride over the scarfed surface and press against it without trouble.

The scarfed surface engagement member 21, rather than being driven by a cylinder as described above, may be fixed at a position such that the bottom surface 23 is on a plane including the blade tip locus 5*a*, a locus described by the blades 5*b* as the circular saw 5 rotates. This holds the bottom surface 23 as close to the scarfed surface as possible without pressing the scarfed surface and therefore produces almost the same effect as when the scarfed surface is pressed.

The cylinder for pushing the scarfed surface engagement member 21 is mounted on the moving table of the circular saw 5 in much the same way as the pressing cylinder 10 is mounted, so that it can be moved bodily together with the circular saw 5, the pressing member 11 and the rear end pressing member 11'. When the scarfed surface engagement member 21 is to be fixed, it may be secured to the moving table so that it can be moved together with the circular saw 5.

Next, another embodiment will be described by refing to FIGS. 11 and 12.

Figure 11A:
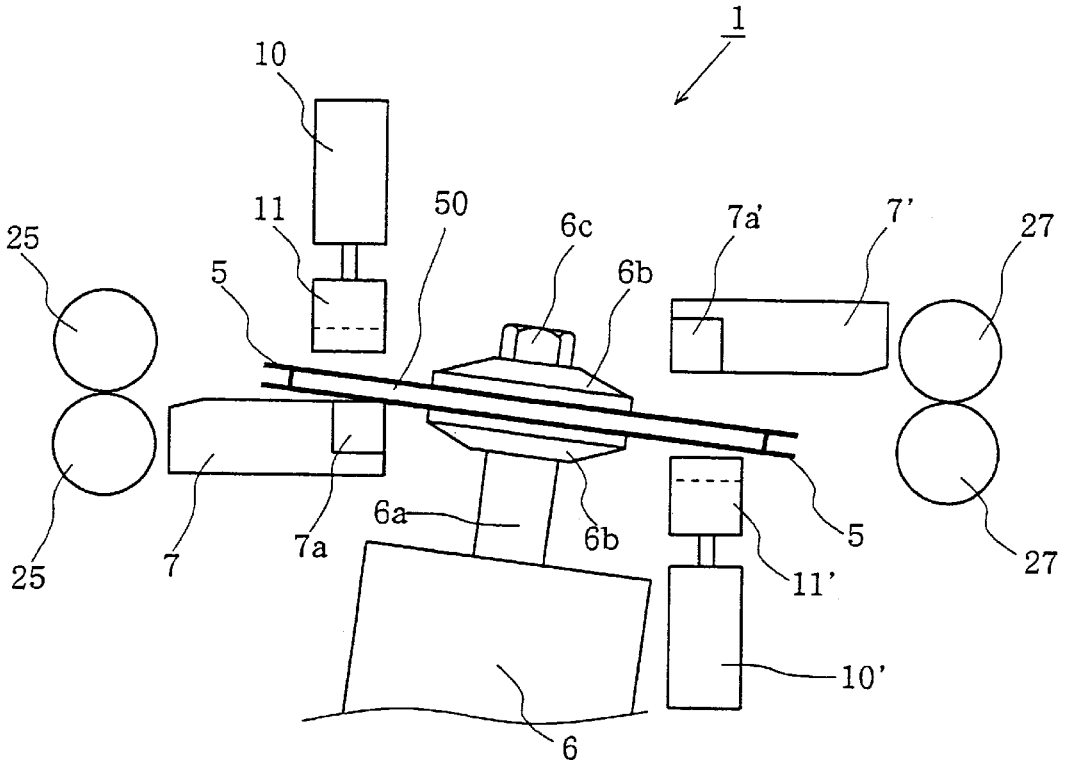
FIGS. 11A and 11B are schematic side views showing other rotary cutters.
Figure 11B:
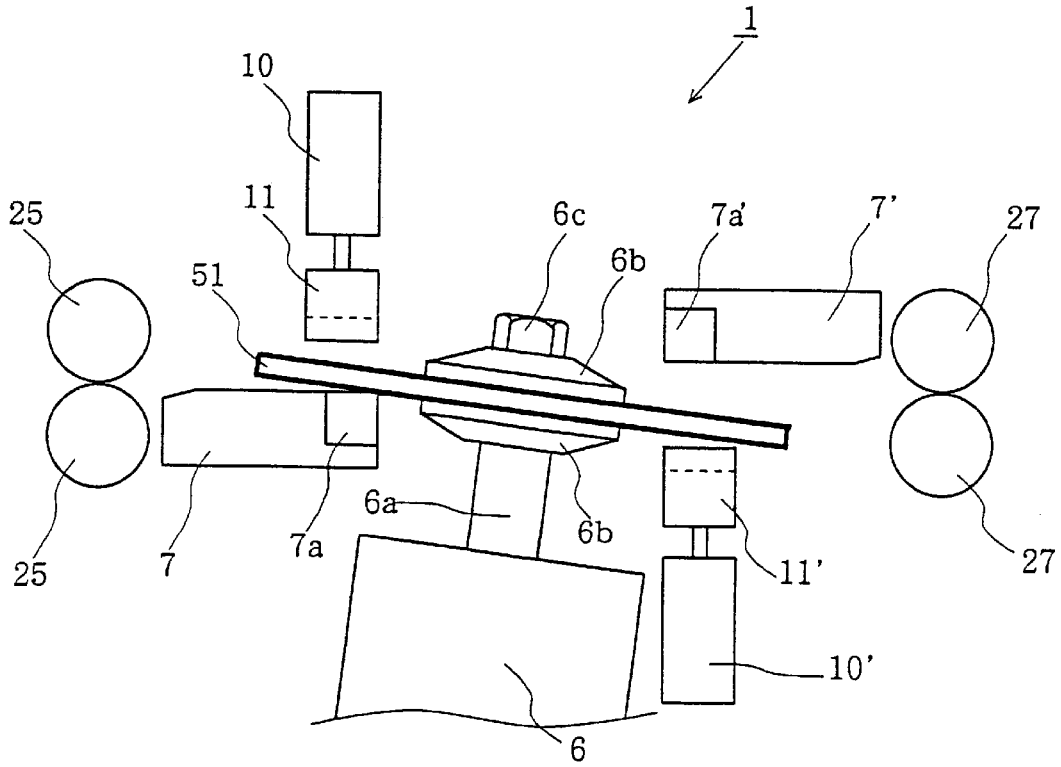

FIGS. 11A and 11B show other rotary cutters for scarfing the veneer 3. The rotary cutter shown in FIG. 11A has two circular saws 5, one for cutting the front end of the veneer and one for cutting the rear end, both securely mounted on the rotating shaft 6*a* of the drive motor 6, with a break saw 50 for crushing the cut chip 17 interposed between the two circular saws 5.

This construction crushes the chip 17 to prevent it from striking against the scarfed surface engagement member 21 as described earlier and also to facilitate the collection of the chip 17 as by a dust collector.

The rotary cutter shown in FIG. 11B has a cutter with thick blades, instead of the circular saw 5, securely mounted on the rotating shaft 6*a* of the drive motor 6. The cutter with this construction can crush the cut chip while scarfing the veneer end, and therefore can produce the same effect as produced by the break saw 50 described above.

Further, the shape of the cutter blades may be changed or a plurality of cutters may be combined to produce a variety of shapes of scarfed surfaces, such as shown in FIGS. 13A through 13D.

Although the preceding description concerns a case where a plate-like material such as a veneer is scarfed, the present invention is not limited to the scarfing of plate-like materials but can also be applied to the cutting of plate-like materials into surfaces such as shown in FIGS. 13A through 13D and into other arbitrary shapes of cut surfaces, and at the same time can increase the cutting precision by controlling surface undulations.

The inclination angle of the circular saw 5 does not have to be fixed at 7 degrees and may be changed as required.

Figure 12:
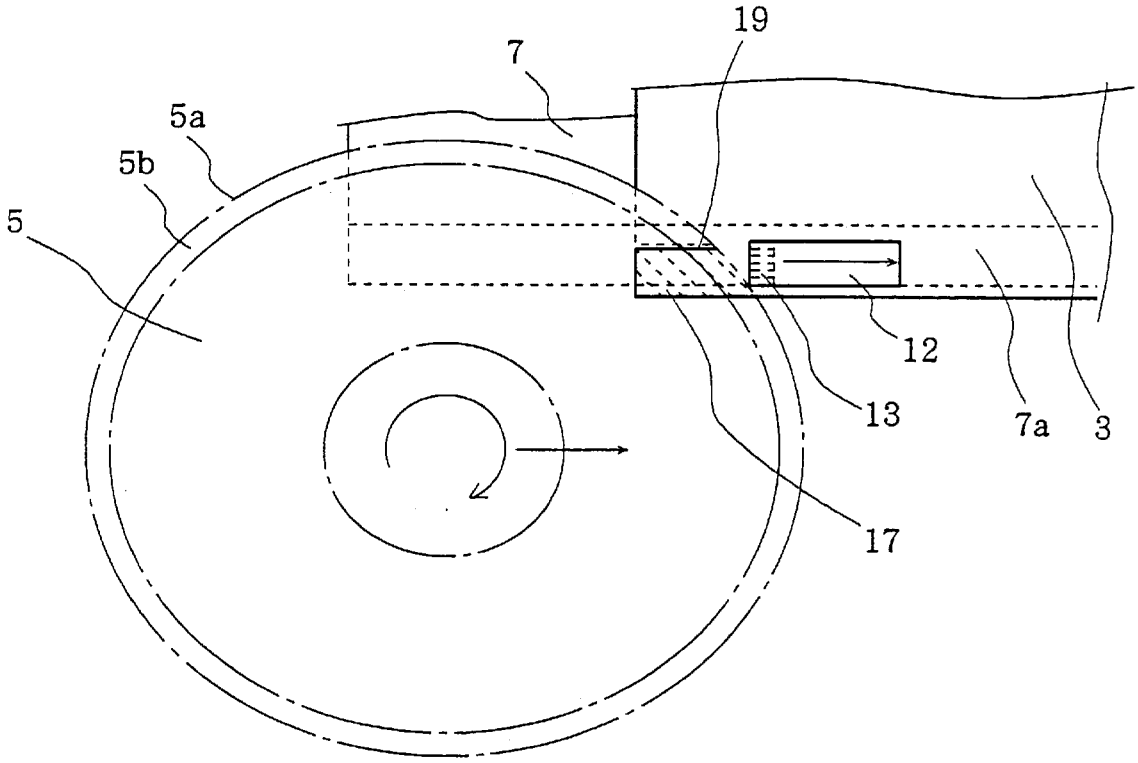
FIG. 12 is a schematic plan view showing another pressing member.
Figure 13A:
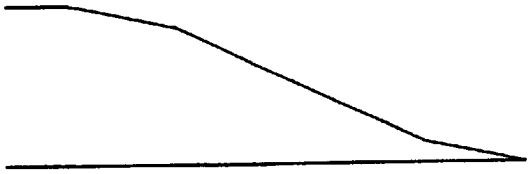
FIGS. 13A and 13D is a side view showing other shapes of cut surfaces.
Figure 13B:
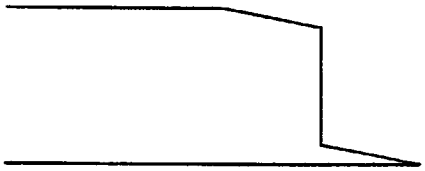
Figure 13C:
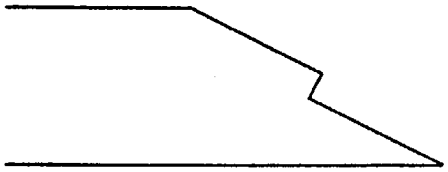
Figure 13D:
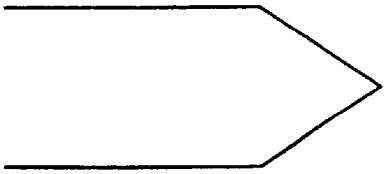

FIG. 12 shows another embodiment of the pressing member. In the figure, reference number 12 represents another pressing member. As can be seen from the figure, the pressed surface 13 between the pressing member 12 and the veneer 3 is not the veneer surface area curved along the blade tip locus 5*a* of the circular saw 5 but a veneer surface of the chip portion close to the blade tip locus 5*a*. Although it is ideal to shape the curved surface 11*a* of the pressing member 11 along the blade tip locus 5*a* of the circular saw 5, the curved surface 11*a* can take other shapes in correcting undulations of the veneer 3 as long as the pressing member 11 presses a veneer surface near the blade tip locus 5*a*.

When the inclination angle of the circular saw 5 is set at a fixed angle, there is no problem. When the inclination angle is changed, the shape of the blade tip locus 5*a* of the circular saw 5 as seen from the arrow A of FIG. 1 also changes. Therefore, if the shape of the curved surface 11*a* of the pressing member 11 is made to correctly match the blade tip locus 5*a* of the circular saw 5 whose inclination angle is changed, it is necessary to change the shape of the curved surface 11*a* each time the inclination angle is changed. Because the curved surface 11*a* of the pressing member 11 may take any desired shape as long as the pressing member 11 can press the veneer surface near the blade tip locus 5*a*, the pressing member 12 such as shown in FIG. 12 can be used. Because this shape of the pressing member 12 is versatile in use, the pressing member 12 can be used as is, without having to be replaced with other shapes of pressing member, even when the inclination of the circular saw is changed.

While the foregoing explanation concerns a case where the circular saw 5 is linearly moved with respect to the veneer 3 held immovable, it is also possible to fix the circular saw 5 and linearly move the veneer 3 relative to the circular saw 5.

In that case, a circular saw for front end cutting and a circular saw for rear end cutting may be separately installed and the veneer 3 moved relative to these circular saws to scarf the front and rear ends simultaneously. The only requirement for this arrangement is to linearly move the circular saw 5 relative to the veneer 3.

When the both ends of the veneer 3 are to be cut, the feed rolls 25 or takeup rolls 27 clamp the veneer 3 so that it is held immovable during cutting. If it is desired to hold the veneer 3 more firmly depending on the thickness and material of the veneer 3, a veneer holder, though not shown, capable of pressing against the cutter receiving table 7 may be provided between the feed rolls 25 and the pressing member 11 to press the veneer 3 during cutting.

Similarly, when the rear end of the veneer is to be cut, a veneer holder, also not shown, capable of pressing against the rear end cutter receiving table 7' may be provided between the takeup rolls 27 and the rear end pressing member 11' to press the veneer 3 during cutting. These veneer holders can be expected to correct undulations of the veneer 3 to some extent.

When the inclination angle of the circular saw 5 is changed as required, the angle of the scarfed surface is also changed. In that case, the inclination angle of the bottom surface 23 of the scarfed surface engagement member 21 needs to be changed according to the inclination angle of the scarfed surface.

Further, when, as described earlier, the scarfed surface engagement member 21 is fixed, rather than being driven by a cylinder, at a position such that the bottom surface 23 of the scarfed surface engagement member 21 is in a plane including the blade tip locus 5*a*, a locus described by the blades 5*b* as the circular saw 5 rotates, the fixed scarfed surface engagement member 21 may be inclined at the same time that the inclination angle of the circular saw 5 is changed. This arrangement obviates the need to change the scarfed surface engagement member 21 each time the inclination angle of the circular saw 5 is changed.

Further, as already described, the break saw 50 may be used to crush the chip 17 to avoid its impingement against the scarfed surface engagement member 21. When the break saw 50 is not used, if an inclined portion is provided to the curved surface portion 21*a* of the scarfed surface engagement member 21, the chip 17 can be discharged along the inclined portion, thus preventing the collision of the chip 17. In terms of collecting the chip efficiently, it is better to use the break saw to crush the chip and facilitate the collection of the chip.

Because of the construction as described above, the present invention offers the following advantages and effects.

First, on the downstream side of a rotary cutter with respect to the direction of a cutter linear movement relative to a plate-like material, a pressing member presses during the cutting operation at least a part of the surface of at least that portion of the plate-like material which is to be cut away as a chip from the plate-like material at a position near the blades of the rotary cutter, the surface of the plate-like material pressed by the pressing member being opposite the other surface held in contact with the cutter receiving table. Because of this arrangement, if there are undulations on the plate-like material, those undulations near the portion to be cut away are successively corrected flat by the action of the pressing member and the cutter receiving table and the rotary cutter cuts the flattened portion, thus realizing a good cut surface with high machining precision not possible so far.

Second, on the upstream side of the rotary cutter with respect to the direction of a cutter linear movement relative to the plate-like material, a cut surface engagement member during cutting is pressed against or set close to the scarfed surface near the blades of the rotary cutter. This prevents the scarfed surface from being contacted again and damaged by the blades of the rotary cutter, thereby assuring a high-precision cut surface.

What is claimed is:

1. A method of scarfing a plate-like material comprising the steps of:

feeding a plate-like material to move said plate-like material in a predetermined direction;

stopping said feed of the plate-like material at a predetermined cutting position where a cutter receiving table is provided on one of a top surface side and a back surface side of the plate-like material;

pressing, toward said cutter receiving table, said plate-like material on the surface side opposite to said cutter receiving table at least at a portion to be cut away as a chip by means of a pressing member adapted for relative movement with respect to said plate-like material in a direction perpendicular to the predetermined direction; and scarfing said stopped plate-like material by means of a rotary cutter at said predetermined cutting position in the proximity of said pressing member, said rotary cutter being adapted for movement in the same direction as said pressing member at a same speed as said pressing member to follow said pressing member.

2. A method of scarfing a plate-like material as set forth in claim 1, wherein said pressing member and said rotary cutter are provided on a moving table to assure a bodily movement thereof.

3. A method of scarfing a plate-like material as set forth in any one of claim 1 and claim 2, wherein a scarfed surface engagement member is provided in the proximity of said rotary cutter to be pressed or set close to the scarfed surface formed by said rotary cutter in said plate-like material by following said rotary cutter in the same direction and at the same speed as said rotary cutter.

4. A method of scarfing a plate-like material as set foth in claim 3, wherein said pressing member, said rotary cutter and said scarfed surface engagement member are provided on a moving table to assure a bodily movement thereof.

5. A method of scarfing a plate-like material as set forth in any one of claims 1 through 4, wherein said pressing member is adapted for vertical movements.

6. A method of scarfing a plate-like material as set forth in claim 3, wherein said scarfed surface engagement member is adapted for vertical movements.

7. An apparatus for scarfing a plate-like material comprising:

a cutter receiving table provided on one of a top side and a back side of a plate-like member;

a rotary cutter adapted for linear movement relative to the plate-like member with blades thereof in contact with said plate-like material to cut an end of said plate-like member such that a scarfed surface is formed thereon; and a pressing member provided on an opposite side to said rotary cutter of said plate-like material and on a down stream side of said rotary cutter with respect to a direction of a cutter linear movement relative to the plate-like material in a direction and said pressing member moves at a same speed as said rotary cutter which follows said pressing member and is adapted for pressing toward said cutter receiving table at least a portion to be cut away as a chip.

8. An apparatus for scarfing a plate-like material as set forth in claim 7, wherein said pressing member and said rotary cutter are provided on a moving table to assure a bodily movement thereof.

9. An apparatus for scarfing a plate-like material as set forth in any one of claims 7 and 8, further including a scarfed surface engagement member provided in the proximity of said rotary cutter to press or be set close to a scarfed surface in said plate-like material formed by said rotary cutter, said scarfed surface engagement member being adapted for bodily movement in a same direction at a same speed as said rotary cutter.

10. An apparatus for scarfing a plate-like material as set forth in claim 9, wherein said pressing member, said rotary cutter and said scarfed surface engagement member are provided on a moving table to assuer a bodily movement.

11. An apparatus for scarfing a plate-like material as set forth in any one of claims 7 and 8, said pressing member is adapted for vertical movement.

12. An apparatus for scarfing a plate-like material as set forth in claim 9, wherein said scarfed surface engagement member is adapted for vertical movement.

* * * * *

US006112786B1

(12) REEXAMINATION CERTIFICATE (4487th)

United States Patent

Otsuka et al.

(10) Number: US 6,112,786 C1

(45) Certificate Issued: Nov. 6, 2001

(54) METHOD AND APPARATUS FOR SCARFING A PLATE-LIKE MATERIAL

(75) Inventors: Toshiyuki Otsuka; Kiichi Yamamoto, both of Obu (JP)

(73) Assignee: Meinan Machinery Works, Inc., Obu (JP)

Reexamination Request:
No. 90/005,897, Dec. 27, 2000

Reexamination Certificate for:

| | |
|---|---|
| Patent No.: | **6,112,786** |
| Issued: | **Sep. 5, 2000** |
| Appl. No.: | **09/332,021** |
| Filed: | **Jun. 14, 1999** |

(30) Foreign Application Priority Data

Jun. 16, 1998 (JP) ..... 10-186866

(51) Int. Cl.[7] ..... B27M 1/00; B27L 3/00

(52) U.S. Cl. ..... 144/363; 144/2.1; 144/90.1; 144/91; 144/136.1; 144/329; 409/201; 409/205; 269/55

(56) References Cited

U.S. PATENT DOCUMENTS 2,311,215 2/1943 Duffy et al. .

FOREIGN PATENT DOCUMENTS

| | | |
|---|---|---|
| 495927 | 11/1938 | (GB) . |
| 7-26101 | 5/1995 | (JP) . |
| 7-45287 | 10/1995 | (JP) . |

*Primary Examiner*—Ed Tolan

(57) ABSTRACT

When scarfing the end portion of a plate-like material with irregular deformations or undulations, such as distortions, undulations and warps, the undulations are successively corrected flat and the flattened end portion is scarfed by a rotary cutter to form a highly precise scarfed surface. When the end portion of the plate-like material 3 is scarfed by the rotary cutter 5, the pressing member 11 presses, while the cutting operation proceeds, at least a part of the surface of at least that portion of the plate-like material 3 which is to be cut away as a chip 17 at a position near the blades 5b of the rotary cutter 5 on a downstream side of the rotary cutter with respect to a rotary cutter movement direction, the surface of the plate-like material 3 pressed by the pressing member 11 being opposite the other surface held in contact with the cutter receiving table 7.

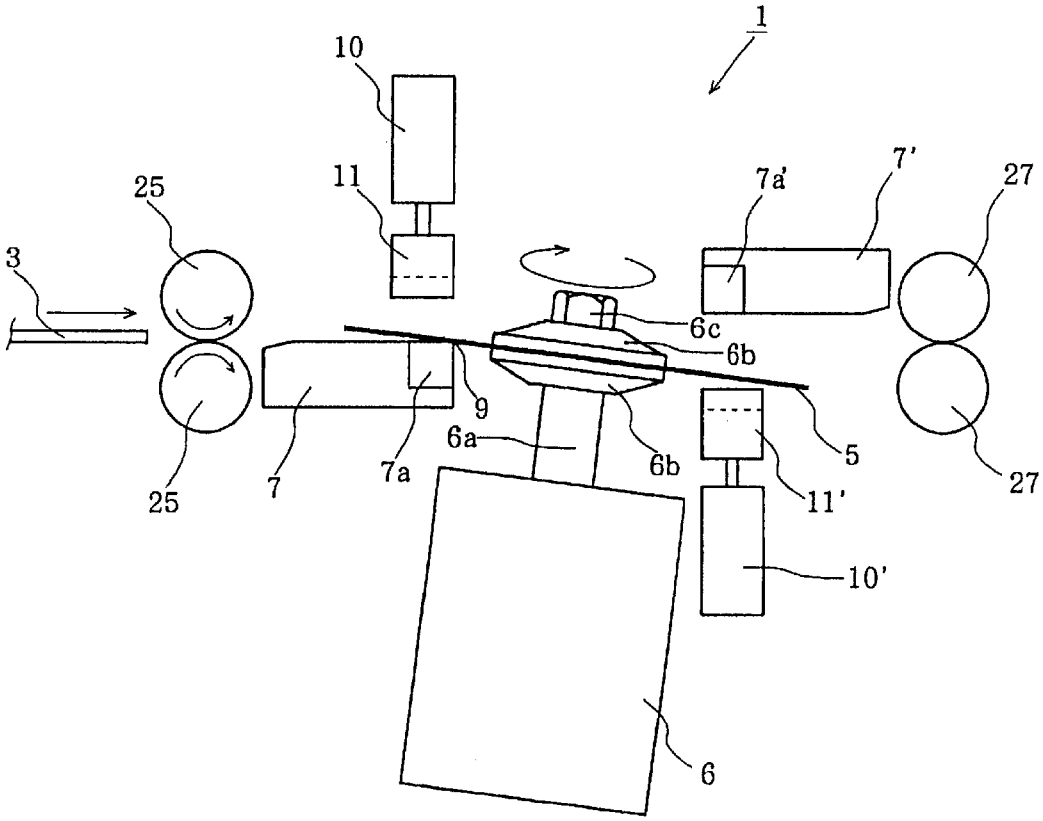

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *